United States Patent [19]

Takahashi et al.

[11] Patent Number: 4,782,712

[45] Date of Patent: Nov. 8, 1988

[54] VARIABLE DISPLACEMENT COMPRESSOR

[75] Inventors: Yukio Takahashi; Kenichi Kawashima; Masaru Ito, all of Katsuta; Atsushi Suginuma, Mito; Kunihiko Takao, Ibaraki, all of Japan

[73] Assignee: Hitachi, Ltd., Tokyo, Japan

[21] Appl. No.: 92,140

[22] Filed: Sep. 2, 1987

[30] Foreign Application Priority Data

Sep. 3, 1986 [JP] Japan ..... 61-205880

[51] Int. Cl.[4] ..... F04B 1/16; F16H 23/08

[52] U.S. Cl. ..... 74/60; 92/12.2; 417/269

[58] Field of Search ..... 74/60; 92/12.2; 417/222, 270, 269

[56] References Cited

U.S. PATENT DOCUMENTS

| | | | |
|---|---|---|---|
| 2,964,234 | 12/1960 | Loomis III | 417/222 |
| 4,061,443 | 12/1977 | Black | 417/222 |
| 4,178,135 | 12/1979 | Roberts | 417/222 |
| 4,475,871 | 10/1984 | Roberts | 417/270 X |
| 4,526,516 | 7/1985 | Swain et al. | 417/270 X |
| 4,632,640 | 12/1986 | Terauchi | 417/269 |
| 4,685,866 | 8/1987 | Takenaka et al. | 417/270 |
| 4,688,997 | 8/1987 | Suzuki et al. | 417/222 |

*Primary Examiner*—Allan D. Herrmann

*Attorney, Agent, or Firm*—Antonelli, Terry & Wands

[57] ABSTRACT

A variable displacement compressor has a sleeve axially slidably mounted on an axial drive shaft and a swash plate tiltably connected to the sleeve. The angle of the tilt of the swash plate is variable by an axial movement of the sleeve and a movement of the swash plate along a guiding cam track to vary the compressor displacement. The guiding cam track is provided by a cam groove having a form of a closed loop and formed in a driving plate drivingly connected to the drive shaft and to the swash plate to transmit the torque of the drive shaft to the swash plate. A fulcrum pin is provided on the swash plate and engaged in the cam groove and is movable along the guide groove toward the drive shaft as the angle of tilt of the swash plate is decreased.

3 Claims, 6 Drawing Sheets

VARIABLE DISPLACEMENT COMPRESSOR

BACKGROUND OF THE INVENTION

The present invention relates to a variable displacement compressor and, more particularly, to a variable displacement compressor having axial pistons carried by a swash plate the tilting angle of which is varied to control the stroke of the pistons and, hence, the displacement of the compressor.

In general, a variable displacement compressor of the type mentioned above has a swash plate mechanism adapted to be rotated by a shaft which in turn is driven by the power of, for example, an engine. The swash plate mechanism carries a plurality of axial pistons. The angle of tilt of the swash plate mecahnism is changed so as to vary the stroke of the axial pistons, thereby controlling the displacement of the compressor. More specifically, the control of the displacement is conducted by varying the angle of tilt of the swash plate about its fulcrum or supporting plate. Various types of mechanism are available for effecting this control.

For instance, the specification of U.S. Pat. No. 2,964,234 discloses a mechanism in which, as shown in FIG. 4 of the present application, a torque-transmitting lug 41 provided on a drive shaft 40 carries a falcrum pin 44 which engages with a cam groove 43 formed in a swash plate 42. In operation, a sleeve 45 which rotatably supports the swash plate 42 is displaced axially and the cam groove is made to move relative to the fulcrum pin 44, thereby effecting tilting action and the control of tilting angle of the swash plate 42. This arrangement is characterized in that the fulcrum pin 44 is kept stationary while the cam groove 43 is moved.

Another known mechanism disclosed in the specification of U.S. Pat. No. 4,061,443 has, as shown in FIG. 6, a torque-transmitting lug 51 provided on a drive shaft 50 has a cam groove 52 which engages with a fulcrum pin 54 on a swash plate 53. The swash plate 53 is connected through a connector pin 57 to a sleeve 55 slidably mounted on the drive shaft 50. In operation, the sleeve 55 is made to slide on the drive shaft 50 and the fulcrum pin 54 is made to move along the cam groove 52 in the lug 51, thereby conducting the tilting operation and the control of the tilting angle of the swash plate 53. Thus, this arrangement features a combination of a movable fulcrum pin 54 and a stationary cam groove 52, in contrast to the known arrangement explained in connection with FIG. 4.

A further known arrangement is proposed in the specification of U.S. Pat. No. 4,178,135. As shown in FIG. 9, this arrangement has a drive plate 61 carried by a drive shaft 60 for rotation as a unit therewith. A cam surface 62 is formed on one axial end face of the drive plate 61. A fulcrum roller 64 carried by a swash plate 63 is urged by a spring 65 into contact with the cam surface 62. The tilting operation and the control of the tilting angle of the swash plate 63 are effected by a movement of the fulcrum roller 64 along the cam surface 62 and by an axial movement of a support pin 66 which supports the swash plate 63. This known arrangement features a combination of the movable fulcrum roller 64 and the stationary cam surface 62.

These known arrangements, however, suffer from the following disadvantages:

In the first-mentioned known arrangement shown in FIG. 4, the position of the fulcrum, i.e., the position of the fulcrum pin 44, is not changed even though the tilting angle $\theta$ of the swash plate 42 is changed, because this arrangement employs a combination of the stationary fulcrum pin 44 and the movable cam groove 43 in the swash plate 42. In consequence, as shown in FIGS. 5A and 5B, the distance $y_p$ between the point of action of the reactional force $F_G$ of the compressed gas transmitted from the pistons and the fulcrum point is constant, so that, if the reactional force $F_G$ of the compressed gas is constant, the tilting moment $M_T(M_T=F_G \cdot y_p)$ of the swash plate 42 about the fulcrum point is constant. The control of the tilting angle of the swash plate 42 relies upon the balance between the tilting moment $M_T$ produced by the reactional force $F_G$ produced by the compressed gas and either a counter control force $F_C$ which is produced by the pressure of the gas in the crank chamber or a load applied to the pin 45 on the swash plate 42. In order to reduce the tilting angle of the swash plate so as to reduce the piston stroke, it is necessary to increase either the control force $F_C$ produced by the internal pressure of the crank chamber or the load applied to the pin 45. For attaining a good response to the control input for controlling the tilting angle, it is desirable that the control force $F_C$ is made as small as possible. In other words, a higher tilting angle response characteristic can be obtained by decreasing the increment of the control force $F_C$ required for the control. Since the tilting angle is maintained by the balance of force between the tilting moment $M_T$ and the control force $F_C$, the reduction in the increment of the control force $F_C$ essentially requires that the tilting moment $M_T$ is decreased. To this end, it is necessary that the distance $y_p$ between the fulcrum of the swash plate and the point of action of the reactional force $F_G$ of the gas is decreased as the tilting angle of the swash plate decreases. To this end, a mechanism is required which would progressively move the fulcrum point 44 towards the drive shaft 40 as the tilting angle decreases. In particular, where the discharge pressure and the suction pressure are constant, the distance $y_G$ between the point of action of the reactional force of the compressed gas and the center of the drive shaft is maintained constant, so that a reduction in the distance $y_p$ is essentially required for the purpose of reducing the tilting moment $M_T$ and, hence, the control force $F_C$. Unfortunately, however, the known arrangement shown in FIG. 4 fails to meet this requirement because the point of the fulcrum, i.e., the point of the pin 44, is unchangeable with respect to the point of action of the reactional force $F_G$.

Referring now to the arrangement explained in connection with FIG. 6, the problem encountered by the first-mentioned known arrangement is overcome because the fulcrum pin 54 provided on the swash plate 53 is movable while the cam groove 52 on the side of the drive shaft 50 is stationary. In this arrangement, the lug 51 is projected through a slot 56 formed in the sleeve 55 which is slidably carried by the drive shaft 50. This construction has the following problem: Namely, as will be seen from FIGS. 7 and 8, the effective area indicated by A with marks "x" for receiving the pressure between the sleeve 55 and the drive shaft at the half circumference of the shaft where the slot 56 is formed, is smaller than at the other half circumference of the shaft. In consequence, a radial component P of the reactional force $F_G$ of the compressed gas transmitted by the pistons acts more heavily on this area A than on the other circumference, resulting in local wear of the sleeve 55 and the drive shaft 50 during repetitional sliding movements of the sleeve 55 on the drive shaft 50.

Referring now to the third known arrangement shown in FIG. 9, the fulcrum roller 64 constituting the fulcrum point for the tilting motion of the swash plate 63 is prevented from moving apart from the cam surface 62 on the drive plate 61 by virtue of the spring 65 which acts to urge the fulcrum roller 64 into contact with the cam surface 62. When the compressor is started, however, a force which tends to move the fulcrum roller 64 from the cam surface 62 is generated by the inertia of the pistons 67 and the friction between the pistons 67 and the respective cylinder bores 68. In consequence, the fulcrum roller 64 is momentarily separated from the cam surface 62 and is then sprung back into contact with the cam surface 62 by the force of the spring 65 and the force produced by the compressed gas. In consequence, the cam surface 62 and/or the fulcrum roller 64 is heavily worn due to repeated collisions therebetween. The cam contour of the cam surface 62 and the shape and size of the support roller 64 must be strictly managed so as to provide a constant top clearance between the free axial end of each piston and the top wall of the associated cylinder bore. However, the heavy wear of the support roller 64 or the cam surface 62 undesirably increases the top clearance.

SUMMARY OF THE INVENTION

Accordingly, an object of the present invention is to provide a variable displacement compressor of the swash plate type which is improved to provide a good response to tilting angle control and to ensure a high durability and high precision of displacement control, thereby overcoming the above-described problems of the prior art.

The variable displacement compressor of the invention basically has a drive shaft, a sleeve which is axially slidably mounted on the drive shaft, a swash plate tiltably connected to the sleeve, and other parts. The control of the tilting angle of the swash plate is effected by an axial movement of the sleeve and a movement of the swash plate along a tilt-guiding cam track.

More specifically, the variable displacement compressor of the present invention has a novel tilting angle control mechanism. A drive plate is disposed in the vicinity of the sleeve in such a manner as to contact with a portion of the swash plate so as to be able to transmit the torque of the drive shaft to the swash plate. A cam groove in the form of a closed loop, which constitutes the above-mentioned cam track for guiding the tilting motion, is formed in the drive plate. A fulcrum pin is provided on the swash plate and engaged with the cam groove so as to be movable therealong. The cam groove is so contoured that the fulcrum pin is moved towards the center of the drive shaft as the angle of tilt of the swash plate decreases.

In operation, when the tilting angle of the swash plate is changed, the fulcrum pin on the swash plate is moved along the cam groove towards the center of the drive shaft so as to reduce the distance factor of the tilting moment as the tilting angle decreases. This in turn reduces the value of the tilting moment and, hence, the tilting angle control force which balances the tilting moment. This means that the control force required for varying the tilting angle of the swash plate can be reduced and, therefore, the response to the tilting angle control is improved.

It is also to be noted that the compressor of the invention does not necessitate any slot in the sleeve for passing a lug with cam groove which is required in the known arrangement explained before in connection with FIG. 6 because the cam groove in the compressor of the invention is formed in the drive plate which is disposed in the vicinity of the sleeve. In consequence, the sleeve and the drive shaft can contact with each other over their entire circumferences, so that the radial component of the reactional force produced by the compressed gas can be born by a greater area than in the above-mentioned known arrangement. In consequence, the pressure of contact between the sleeve and the drive shaft is decreased to minimize the local wear of the sleeve and the drive shaft.

In addition, the cam groove formed in the drive plate has such a closed configuration which encloses the fulcrum pin. In consequence, the momentary separation of the fulcrum pin from the cam surface, which is inevitably caused in the known arrangement explained in connection with FIG. 9 when the compressor is stopped, is avoided thus preventing impacting collision between the fulcrum pin and the cam surface. This effectively suppresses the wear of the cam surface, so that the axial depth of the cam surface is maintained constant to keep the top clearance in each cylinder bore constant, thereby assuring a high precision of the displacement control during long use of the compressor.

DESCRIPTION OF THE PREFERRED EMBODIMENT

Figure 1A:
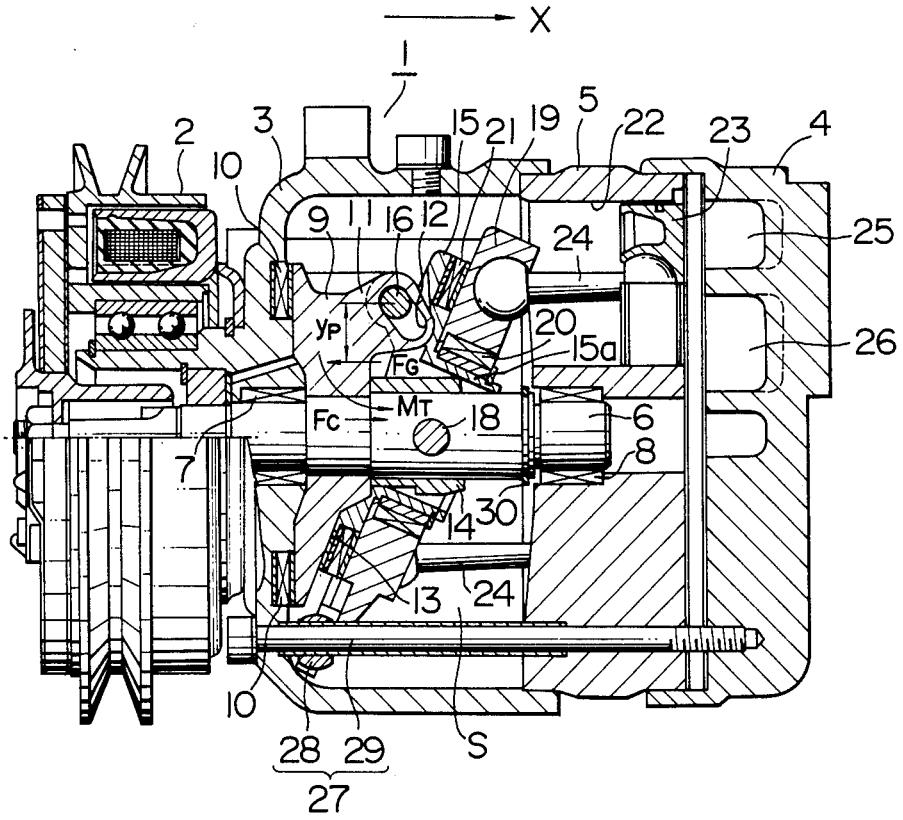
FIGS. 1A and 2 are longitudinal sectional views of an embodiment of a variable displacement compressor of the present invention which is shown in different states of operation.

In FIG. 1A, a variable displacement compressor embodying the present invention is shown in longitudinal section with its swash plate 15 set at the maximum tilting angle to enable the compressor to be operated at its full capacity. In the state shown in FIG. 2, the tilting angle of the swash plate is zero so that the compressor operates with zero displacement.

Referring to these figures, the variable displacement compressor of the present invention is generally denoted by 1. The compressor 1 is adapted to be selectively driven by a suitable power source such as an engine through an electromagnetic clutch 2. The body of the compressor 1 includes a cylinder block 5 to both ends of which are connected a front cover 3 and a rear cover 4.

The driving power is transmitted through the electromagnetic clutch 2 to a drive shaft 6 of the compressor 1. The drive shaft 6 is supported at its one end by a radial bearing 7 provided on the front cover 3 and at its other end by a radial bearing 8 provided at the center of the cylinder block 5.

A drive plate 9 which is press-fit onto the drive shaft 6 is supported at its one side by a thrust bearing 10 provided inside the front cover 3 and is adapted to rotate as a unit with the drive shaft 6. The other side of the drive plate 9 is provided with a lug 11 projected therefrom and having a cam groove 12 which has a form of a closed loop. The drive plate 9 is provided with a slant surface portion 13 which is contacted by a portion of a swash plate 15 when the latter has been tilted to the maximum tilting angle.

A sleeve 14 is slidably mounted on the drive shaft 6 and has pin-receiving holes (not shown) which are spaced from each other in the circumferential direction of the sleeve 14. The sleeve 14 is so shaped and sized that the entire area of the inner peripheral surface thereof makes a sliding contact with the outer peripheral surface of the drive shaft 6. The arrangement is such that, when the swash plate 15 is set at the maximum tilting angle, the sleeve 14 contacts at its one end with the drive plate 9, whereas, when the tilting angle of the swash plate is zero, the other end of the sleeve 14 is engaged with and stopped by a stopper ring 30 provided on the portion of the drive shaft 6 adjacent to the cylinder block 5. Thus, the sleeve 14 is slidable along the drive shaft 6 between stroke ends which are defined by the drive plate 9 and the stopper ring 30.

The swash plate 15 has a substantially L-shaped cross-section providing a boss 15*a* having a bore the diameter of which is large enough t loosely receive the drive shaft 6. Thus, the drive shaft 6 is loosely received in the bore on the boss 15*a* of the swash plate 15. A pair of lugs 17 cooperate to carry a fulcrum pin 16 and are formed on the portion of the swash plate 15 opposite to the boss 15*a*. In the assembled state of the compressor, the lugs 17 on the swash plate and the lug 11 on the drive plate 9 are held in contact with and in side-by-side relation to each other with the fulcrum pin 16 received in the closed loop of the cam groove 12 so as to be able to follow the cam contour of this cam groove 12. A pair of diametrically opposing connecting pins 18 are provided on the inner peripheral surface of the boss 15*a* of the swash plate 15 and directed to the center of the drive shaft. These pins 18 are received in the aforementioned pin-receiving holes in the sleeve 14. As the drive plate 9 is rotated by the rotation of the drive shaft 6, the torque of the drive plate 9 is transmitted to the swash plate 15 through the mutual contact between the lugs 11 and 17, so that the swash plate makes an oscillatory rotary motion along a predetermined locus. The angle of tilt of the swash plate 15 is variable by an axial movement of the sleeve 14 and the movement of the fulcrum pin 16 along the cam groove 12. Obviously, the sleeve 14 is rotated in synchronism with the rotation of the swash plate 15 because it is connected to the swash plate 15 through the connecting pins 18.

A piston carrier 19 has an annular form with its inner peripheral surface supported by the outer peripheral surface of the boss 15*a* of the swash plate 15 with a radial bearing 20 interposed therebetween. The piston carrier 19 also is supported at its one axial end by a thrust bearing 21 on the swash plate 15. The arrangement is such that the piston carrier 19 supported by the radial bearing 20 and the thrust bearing 21 is kept stationary in the rotational direction when the swash plate is rotated, while the oscillatory motion of the swash plate is transmitted to the piston carrier. The piston carrier 19 is arranged to axially face a plurality of cylinder bores 22 which are formed in the cylinder block 5 at a constant circumferential pitch. Each cylinder bore 22 slidably receives a piston 23 such that the piston 23 can reciprocatingly move in the cylinder bore 22. The pistons 23 are connected to the piston carrier 19 through connecting rods 24 which are provided on both axial ends thereof with slide couples. The cylinder block 5 is provided with a suction port 25, through which a gas is sucked into the cylinder bores in a suction phase, and a discharge port 26 through which the gas is discharged under pressure from the cylinder bores in a compression phase. The piston carrier 19 is prevented from rotating by a rotation-prevention mechanism 27 which has a slider 28 attached to the piston carrier 19 and an axial guide bar 29 for causing the slider 28 to reciprocally slide.

Figure 1B:
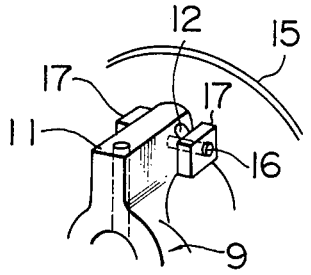
FIG. 1B is a perspective view of a lug on a drive plate and lugs on a swash plate, illustrating slidable engagement between a cam groove and a fulcrum pin.

In operation, the control of the tilting angle of the swash plate, i.e., the control of the displacement of the compressor, is based upon the balance between the tilting moment $M_T$, which is produced by the reactional force $F_G$ of the compressed gas acting on the pistons 23 in the respective cylinder bores 22, and the tilting control force $F_C$ which acts in the counter direction to the tilting moment $M_T$ and is produced by the internal pressure of a crank chamber and a load acting on the sleeve 14. In the described embodiment, if the control force $F_C$ is made sufficiently small as compared with the tilting moment $M_T$ produced by the pressures of the gas compressed in the cylinder bores, the tilting moment overcomes the control force so that the swash plate 15 is tilted to the maximum tilting angle, as shown in FIG. 1. In this state, the sleeve 14 contacts at its one end with a portion of the drive plate 9 thereby preventing any further tilting of the swash plate 15. As the drive shaft 6 is rotated in this state, the drive plate 9 and the swash plate 15 are rotated together so that the oscillatory rotation of the swash plate is conducted at the maximum tilting angle of the swash plate 15. Only the axial component of this oscillatory rotation is transmitted to the piston carrier 19 through the bearings 20 and 21 thereby maximizing the strokes of the pistons 23.

Figure 2:
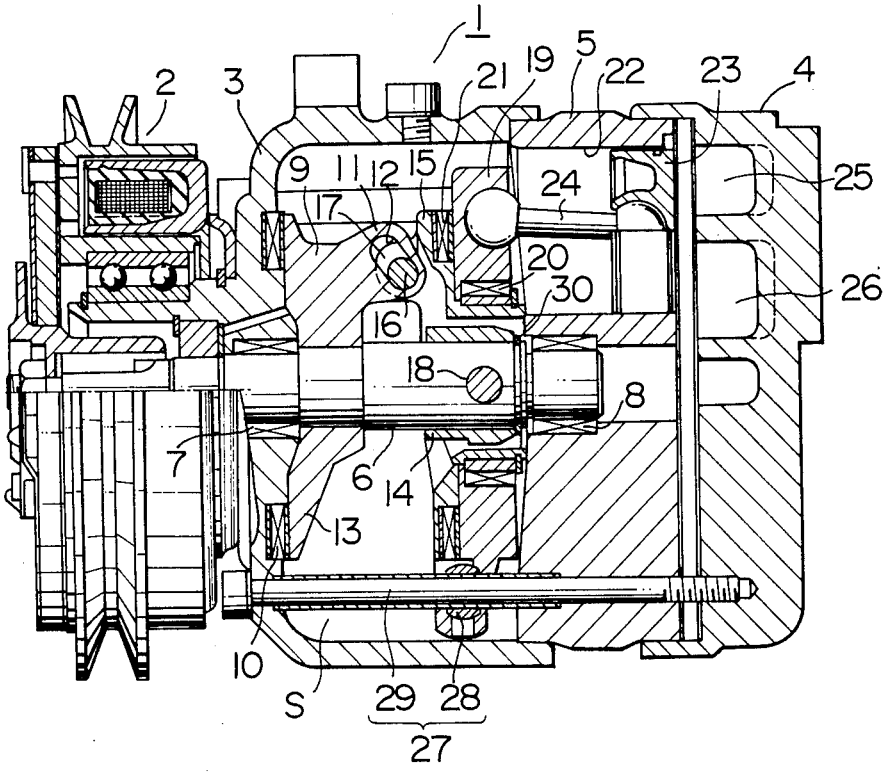

As the tilting control force $F_C$ is increased, the sleeve 14 is moved towards the cylinder block 5, i.e., in the direction of the arrow X, and the fulcrum pin 16 moves along the cam groove 12 toward the drive shaft 6, so that the angle of tilt of the swash plate 15 is decreased. When the tilting control force $F_C$ reaches a predetermined level, the sleeve 14 moves to the position of the stopper ring 30 and the fulcrum pin 16 reaches the end of the cam groove 12 adjacent to the drive shaft 6, whereby the tilting angle of the swash plate 15 is reduced to zero as shown in FIG. 2. In this state, the compression displacement is zero, i.e., the compressor does not perform any compression.

Thus, the fulcrum pin 16 progressively approaches the drive shaft 6 as the angle of tilt of the swash plate is decreased. This movement correspondingly reduces the distance $y_p$ between the fulcrum point of the tilting moment, i.e., the position of the fulcrum pin 16, and the point of action of the reactional force $F_g$ produced by the compressed gas. The reduction in the distance $y_p$ in turn reduces the value of the tilting moment $M_T$ which is given by $M_T = F_G \cdot y_p$. This means that the tilting angle of the swash plate can be controlled with a smaller force, thus improving the tilting angle control response characteristic.

Figure 3:
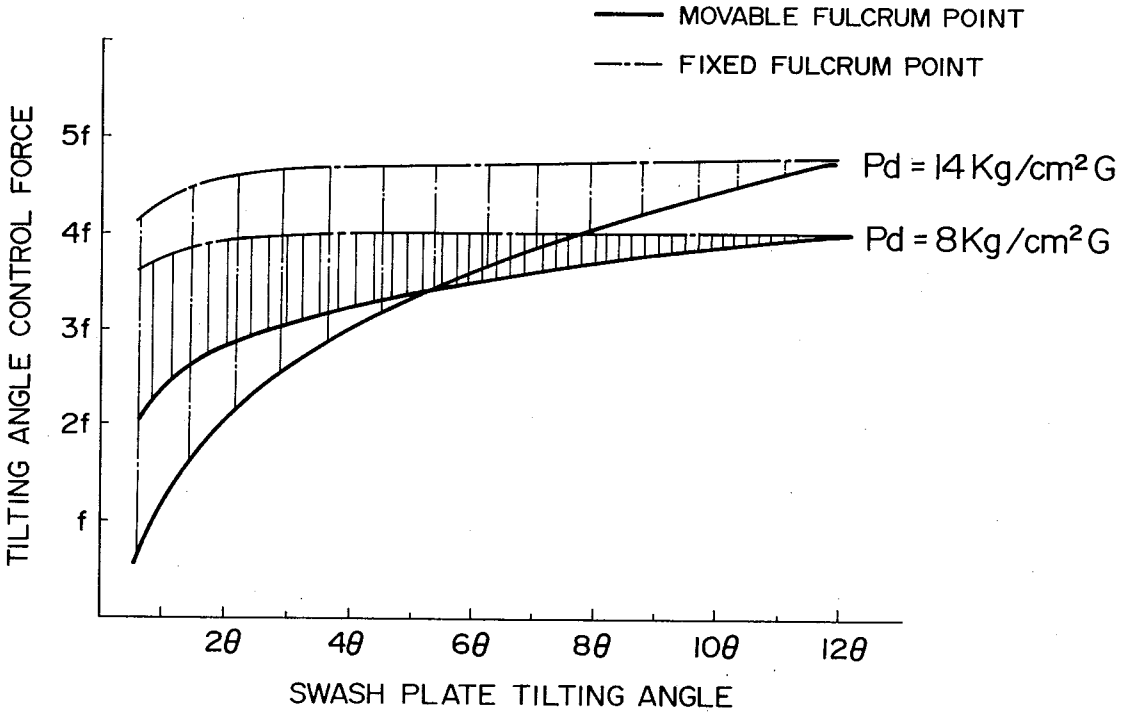
FIG. 3 is a characteristic diagram showing the relationship between the change in the tilting angle of a swash plate and a control force required for effecting such a change in the tilting angle in the fulcrum point moving type compressor of the invention shown in FIG. 1A, in comparison with that of a known variable displacement compressor of the fixed fulcrum point type.
Figure 4:
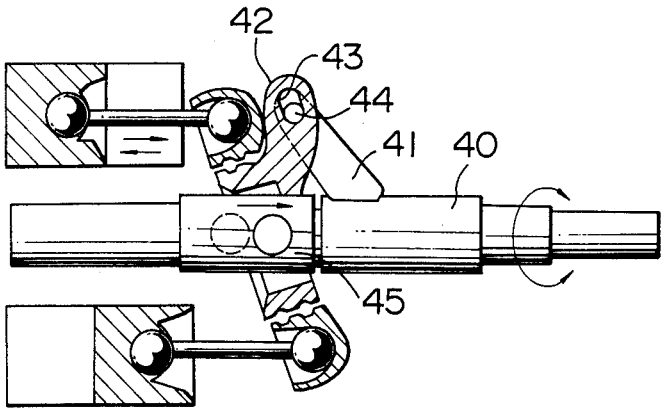
FIG. 4 PRIOR ART
FIG. 4 is a schematic illustration of the known variable displacement compressor.
Figure 5A:
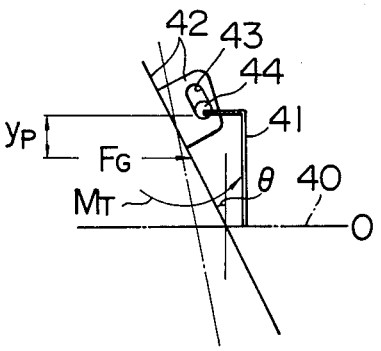
FIG. 5A PRIOR ART
FIGS. 5A and 5B are schematic illustrations of operation of the compressor shown in FIG. 4.
Figure 5B:
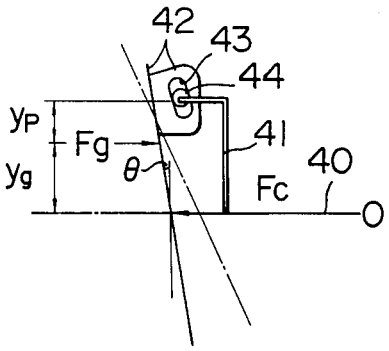
FIG. 5B PRIOR ART

FIG. 3 shows the relationship between the tilting angle of the swash plate and the tilting control force $F_C$ required for controlling the tilting angle in each of two cases; namely, a case where the control of the tilting angle is conducted by varying the fulcrum point as in the described embodiment and a case where the control of the tilting angle is effected by moving the cam groove about a fulcrum pin which is positioned at the fulcrum point fixed at a position corresponding to the maximum tilting angle. The characteristic of the described embodiment, i.e., the characteristic of the movable fulcrum point type, is shown by solid-line curves, while the characteristic of the fixed fulcrum point type is shown by broken-line curves. These characteristic curves are when discharge pressures $P_d$ are set at 14 $kg/cm^2G$ and 8 $kg/cm^2G$ in each case. As will be understood from FIG. 3, the control force $F_C$ required for the control of the tilting angle is much smaller in the compressor of the described embodiment in which the fulcrum point is movable than in the compressor of the fixed fulcrum point type regardless of the discharge pressure $P_d$, and the difference in the control force $F_C$ between both types becomes greater as the angle of tilt of the swash plate becomes smaller. Thus, the present invention makes it possible to reduce the level of the tilting angle control force $F_C$ as compared with the known apparatus having a fixed fulcrum.

Figure 6:
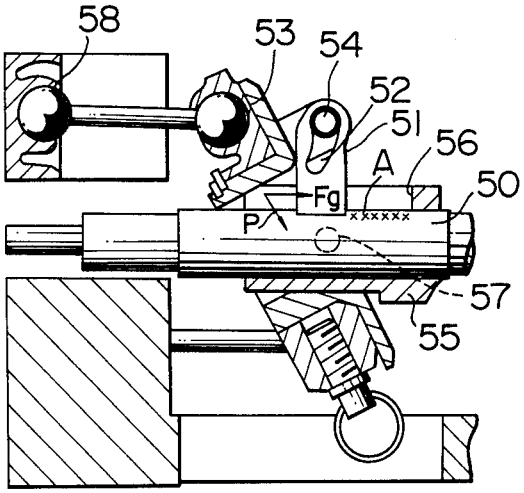
FIG. 6 PRIOR ART
FIG. 6 is a schematic illustration of the other known variable displacement compressor.
Figure 7:
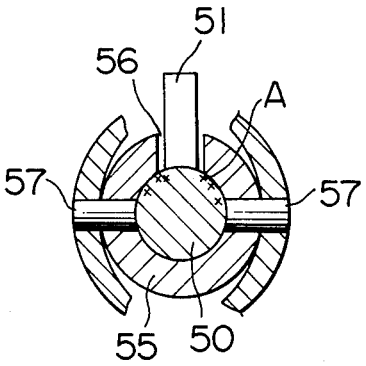
FIG. 7 PRIOR ART
FIG. 7 is a partly-removed cross-sectional view of an critical portion of the compressor shown in FIG. 6.
Figure 8:
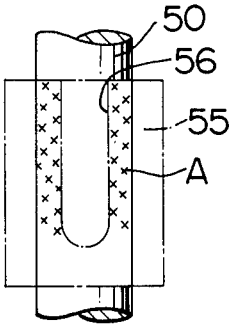
FIG. 8 PRIOR ART
FIG. 8 is a schematic transparent illustration of the critical portion shown in FIG. 7.

It will also be seen that the described embodiment does not necessitate any slot 56 (see FIGS. 6 to 8) which is essentially formed in the sleeve in the known arrangement explained before in connection with FIGS. 6 to 8. Furthermore, it is possible to maintain the inner peripheral surface of the sleeve 14 in contact with the outer peripheral surface of the drive shaft over its entire length and circumference. In consequence, the pressure of contact between the sleeve 14 and the drive shaft 6 produced by the radial component of the reactional force of the compressed gas is decreased thereby minimizing the local wear of the contacting surfaces of the sleeve 14 and the drive shaft 6. In consequence, the durability of the compressor is improved advantageously.

Figure 9:
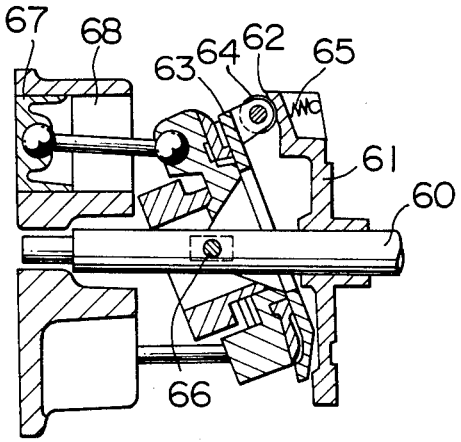
FIG. 9 PRIOR ART
FIG. 9 is a schematic sectional view of a critical portion of the further known variable displacement compressor.

Representing the overall length of the sleeve 14 by l and the diameter of the drive shaft 6 by d, the ratio λ between the contact pressure developed when there is a slot in the sleeve and the contact pressure developed when there is no slot is given as follows:

$$\lambda = (ld - A)/ld = 1 - A/ld$$

where A represents the area of the slot. As will be seen from this formula, the contact pressure can be reduced by an amount corresponding to A/ld as compared with the case where the sleeve has the slot., It is also to be understood that, in this embodiment, the fulcrum pin 16 is always held in the cam groove 12 without leaving any substantial clearance therebetween, unlike the known arrangement shown in FIG. 9 in which the fulcrum roller 64 merely contacts the opened cam surface 62. In the described embodiment, therefore, there is no risk for the fulcrum pin 16 to be momentarily moved apart from the cam surface, so that any impacting contact of the fulcrum pin with the cam surface and a consequent wear of the cam surface are suppressed. This in turn eliminates any dimensional change due to such a wear of the cam surface, so that the planned relationship between the cam surface and the fulcrum pin is maintained for a long time to keep a constant top clearance between the pistons and the top walls of the cylinder block, thereby ensuring a high precision of the displacement control for a long period of time.

In addition, in the described embodiment, the maximum tilting angle of the swash plate 15 is determined by the engagement of the drive plate 9 and one end of the sleeve 14. This relieves the cam surface (cam groove 12) on the drive plate 9 from the role of a limit for determining the maximum tilting angle of the swash plate, thus facilitating the machining for the formation of the cam groove 12.

As will be understood from the foregoing description, according to the present invention, it is possible to reduce the control force $F_C$ necessary for the control of the tilting angle of the swash plate and, hence, to improve the response to the tilting angle control, while minimizing any local wear of significant parts of the compressor thereby ensuring higher durability and higher precision of the displacement control.

What is claimed is:

1. In a variable displacement compressor of the type that includes a drive shaft, a sleeve axially slidably mounted on said drive shaft, a swash plate tiltably connected to said sleeve through connecting pins and adapted to make an oscillatory rotation, a piston carrier mounted on said swash plate through bearing means, and pistons drivingly connected to said piston carrier and slidably received in cylinder bores so as to be reciprocatingly moved in said cylinder bores in response to the oscillatory rotation of said swash plate, the angle of tilt of said swash plate being variable by an axial movement of said sleeve and a movement of said swash plate the improvement comprising:

a driving plate fixed to said drive shaft and engaged with said swash plate so as to transmit the torque of said drive shaft to said swash plate;

a fulcrum pin connected between a pair of lugs projecting from a first surface of said swash plate causing said fulcrum pin to be moveable together with said swash plate; and a lug projecting axially from a first side of said drive plate, said lug includes therein a cam groove in the form of a closed loop;

wherein said fulcrum pin is moved along said cam groove towards said drive shaft as the tilting angle of said swash plate is decreased.

2. A variable displacement compressor according to claim 1 wherein a second side of said drive plate opposite the first side of the drive plate is positioned in a front cover of said compressor through the intermediary of a thrust bearing.

3. A variable displacement compressor according to claim 1, wherein said swash plate has a substantially L-shaped cross-section which supports said piston carrier with a thrust bearing and a radial bearing interposed therebetween.

* * * * *